US005271573A

United States Patent [19]

Plomer

[11] Patent Number: 5,271,573

[45] Date of Patent: Dec. 21, 1993

[54] WEB SEVERING DEVICE WITH PIVOTABLE BLADE CARRIER STABILIZED AGAINST A SUPPORT ROLL

[76] Inventor: Anton Plomer, Theodor-Schäfer-Strasse 14, W-7920 Heidenheim, Fed. Rep. of Germany

[21] Appl. No.: 931,244

[22] Filed: Aug. 17, 1992

[30] Foreign Application Priority Data

Aug. 24, 1991 [DE] Fed. Rep. of Germany ..... 4128095

[51] Int. Cl.[5] ..... B65H 19/20

[52] U.S. Cl. ..... 242/56 R; 242/66

[58] Field of Search ..... 242/56 R, 66, 65; 83/610-612, 382

[56] References Cited

U.S. PATENT DOCUMENTS 4,408,727 10/1983 Dropczynski ..... 242/56 R 4,444,360 4/1984 Kaipf et al. ..... 242/66 X 4,789,109 12/1988 Kyytsonen et al. ..... 242/56 R

FOREIGN PATENT DOCUMENTS 0232358 11/1985 Japan ..... 242/56 R

*Primary Examiner*—Daniel P. Stodola

*Assistant Examiner*—John F. Rollins

*Attorney, Agent, or Firm*—Caesar, Rivise, Bernstein, Cohen & Pokotilow, Ltd.

[57] ABSTRACT

A web slitting device located in the intermediate space between a product web and two support rolls comprising a blade carrier with blade, which, for the purpose of slitting the web, is connected to a transverse beam so that it can be pivoted toward the web. The blade carrier is designed as an articulated lever, one end of which carries the blade, and the other end (support end), while the blade is slitting, forms a support against the roller not supporting the web, with the result that the blade carrier is automatically locked in position.

2 Claims, 1 Drawing Sheet

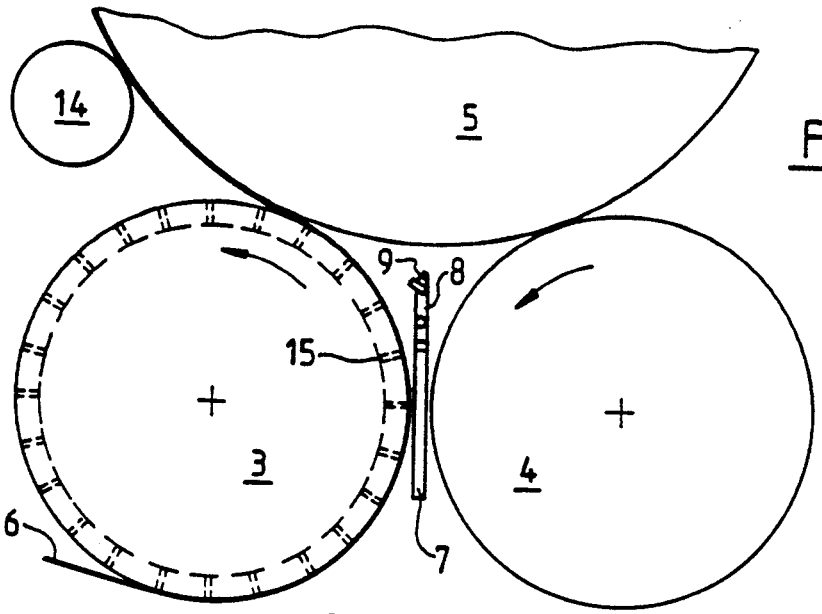
Fig.1
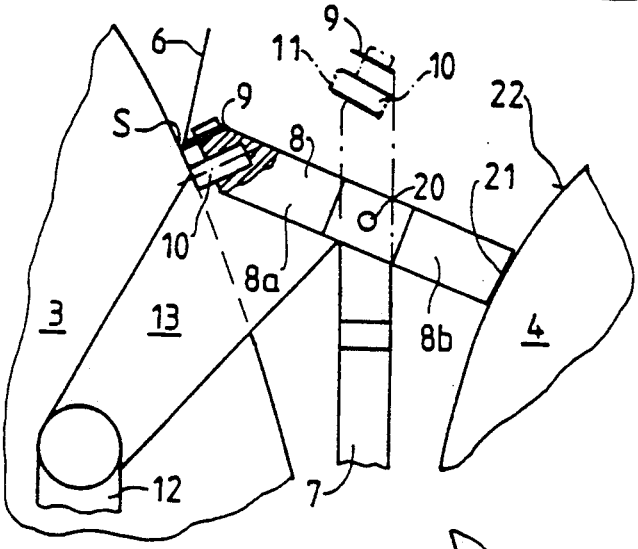
Fig.3
Fig.2
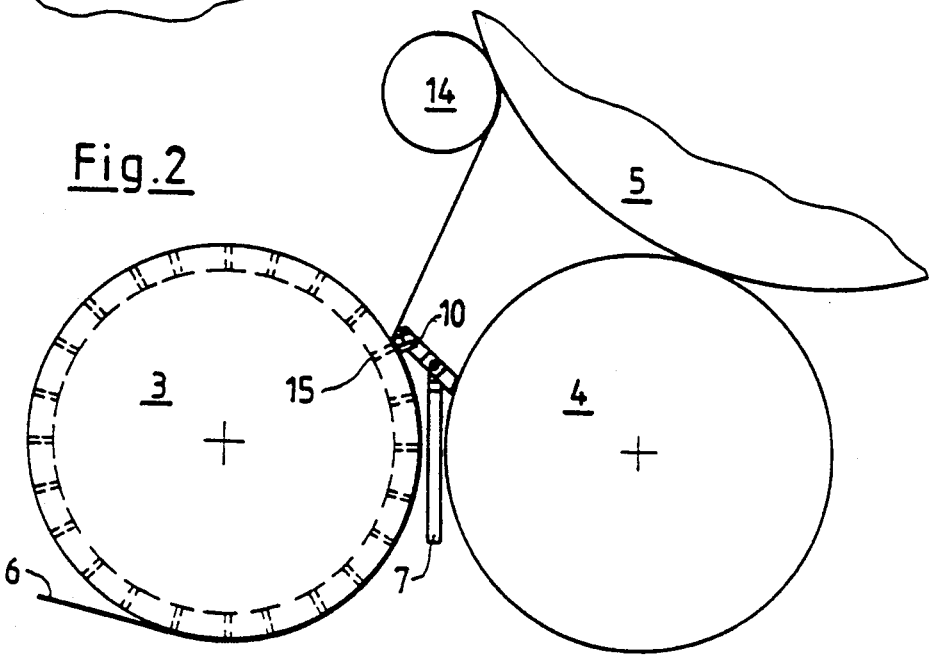

WEB SEVERING DEVICE WITH PIVOTABLE BLADE CARRIER STABILIZED AGAINST A SUPPORT ROLL

FIELD OF THE INVENTION

The invention pertains to a winding machine having a blade carrier which is designed as an articulated lever.

BACKGROUND ART

A winding machine of this general type is known from W. German Offenlegungsschrift No. 3,109,587 C2 which discloses a mechanism to prevent the blade from damaging the drive surface of the roller around which the web was wrapped when the web was slit. For this purpose, the blade carrier of 3,109,587 C2 was provided with a retaining element, which, during the slitting operation, is able to support itself on the paper web and thus on the lateral surface of the web-encircled roller. As a result of the foregoing, it was possible to maintain a certain minimum distance between the slitting edge of the blade and the lateral surface of the roller.

A similar device is known from W. German Auslegeschrift No. 2,930,474. Here the narrow edge of the retaining element is provided with recesses and works together with a perforating blade provided with corresponding recesses. The blade is moved toward the retaining element along a path essentially parallel to the periphery of the support roll, a certain distance away from its surface. The retaining element and the perforating blade, however, must be mounted separately, and each requires its own drive to pivot it.

Reference should also be made to W. German Offenlegungsschrift No. 2,920,707. In this case, the slitting edge of the blade is presented against the lateral surface of the support roll in question, as a result of which this surface can be damaged.

OBJECTS OF THE INVENTION

In the case of winding machines of the general type in question, another problem occurs, which becomes especially acute in the case of heavy, stiff grades of paper. Namely, if the finished, wound-up roll of paper is ejected from the winding bed so that the web to be slit rests under tension on the slitting edge of the blade, a force is exerted on the blade and thus on the blade carrier and on the entire web slitting system. The web slitting system usually consists of a plate as wide as the machine, which is supported at both ends. This plate and possibly the blade carrier are bent by the action of the force just described. If the blade is no longer especially sharp, it is possible for the various components to be bent to such an extent that the web cannot be slit at all.

A conceivable means of remedying this situation would be to increase the stiffness of the slitting device as a whole, especially the plate mentioned above. But there are limits to this, because there is only a minimal amount of intermediate space between the two support rolls. Even if the plate were made stiff enough to withstand the force without bending, the force nevertheless has a disadvantageous effect on the joint by which the blade carrier is connected to the plate. There are also limits to which the dimensions of this joint can be increased.

SUMMARY OF THE INVENTION

The present invention is based on the task of designing a winding machine having a blade carrier which is designed as an articulated lever, with the present invention stiff, heavy grades of paper, the slitting device or its components do not bend; so that unacceptably high forces are not allowed to act on the joint between the blade carrier and the plate; and so that it is ensured in all cases that the web can be properly slit.

This task is accomplished by providing a blade carrier which is designed as an articulated lever.

BRIEF DESCRIPTION OF THE DRAWINGS

The Invention is explained in greater detail below on the basis of exemplary embodiments with reference to the following figures of the drawing.

FIGS. 1 and 2 are schematic diagrams of a double-roll winding machine, seen from the side, with a slitting device according to the invention in two different operating positions; and FIG. 3 shows an enlarged view of the area of the slitting device during the slitting of the product web.

DESCRIPTION OF THE PREFERRED EMBODIMENT OF THE INVENTION

Referring now to the drawings wherein like reference characters are used, FIG. 1 shows a completely wound and finished paper roll 5, resting on two support rolls 3, 4 of a support roll winding machine.

The incoming product web 6, which partially encircles support roll 3, has not yet been separated from the finished, would paper roll 5. A slitting device has already been lifted into the space between the two support rollers 3, 4, i.e., into the angle formed between support rolls 3, 4 and paper roll 5.

The slitting device consists of a beam 7, extending toward both sides, which has at its upper end a pivoting blade carrier 8, to which a tear-off blade 9 is screwed. A certain distance away from tear-off blade 9, retaining elements 10, designed as bolts, are screwed into blade carrier 8, spaced out over the width of the blade.

The ends of retaining elements 10 facing support roll 3 are provided with felt coverings 11.

By means of lateral rod linkages 12, which act on levers 13 permanently attached to blade carrier 8, the carrier can be pivoted toward support rolls 3 (FIGS. 2 and 3). In this operating position, retaining elements 10 clamp product web 6 tightly against support roll 3, whereas a small gap "s" remains between the tear-off edge of blade 9 and product web 6. Only after paper roll 5 has been moved by ejector roll 14 away from the second support roller 4 does product web 6 come to rest against the tear-off edge of tear-off blade 9. Such blade can be designed as a perforating edge with teeth in the conventional manner.

Product web 6 is thus separated from finished, wound paper roll 5, and the latter can then be taken away. At this point, a vacuum is applied inside support roll 3. Holes 15 in the lateral surface of the support roll make it possible for this vacuum to hold the cut-off product web firmly in position, so that tear-off blade 9 can be pivoted away from the product web. Thus, the entire slitting device can be lowered to make room for a new winding core. This new core will be positioned in the angle and will then hold the incoming product web against support roll 3. Before winding begins, product web 6 is attached to the winding core in a manner known in itself, e.g., by means of a strip of adhesive on the core.

The essential point is that blade carrier 8 is designed as an articulated lever. It comprises two lever arms 8*a*, 8*b*, as can be seen in FIG. 3. It is attached by its joint to beam 7 as shown at joint 20. Lever arm 8*b* has a support surface 21. This is slightly angled with respect to the longitudinal axis of blade carrier 8 as shown in the operating state according to FIG. 3. Thus, at the moment of slitting, the blade rests more or less flush against lateral surface 22 of support roll 4. When paper roll 5 is ejected from the winding bed, as shown in FIG. 2, tensile stress occurs in web 6 between blade 9 and ejector 14. This stress acts by way of blade 9 on blade carrier 8, in such a way that it tries to pivot the carrier in the clockwise direction around joint 20. This is not possible, however, because of the design according to the invention, namely, because of the bracing of support surface 21 of lever arm 8*b* against adjoining surface 22 of support roll 4. For this reason, however, it is also impossible for beam 7 to bend. On the contrary, the beam 7 remains completely straight, so that, even in the case of stiff, cardboard-like papers, beam 7 does not bend, and therefore web 6 is slit cleanly by blade 9.

Without further elaboration, the foregoing will so fully illustrate our invention that others may, by applying current or future knowledge, adopt the same for use under various conditions of service.

I claim:

1. A winding machine for winding a product web, with two support rolls (3, 4), which are installed parallel to each other to form an intermediate space and together form a winding bed to receive a wound paper roll (5), one of the support rolls (3) being encircled by the web (6) coming from underneath, the machine also having a web slitting device located in the intermediate space, comprising a blade carrier (8) with a blade (9), said blade carrier being an articulated lever pivotally connected to a transverse beam (7) and having a first end (8*a*) of which carries the blade (9), and a second support end (8*b*), which at the time the blade (9) is slitting said web, forms a support for the blade carrier (8) against the lateral surface (22) of the support roll (4) not encircled by the web (6), said blade carrier being pivoted about a joint (20) between said first and second ends.

2. A winding machine according to claim 1, wherein said blade carrier (8) is dimensioned in such a way that the support surface (21) of the lever arm (8*b*) rests against the lateral surface (22) of the roller (4) not encircled by said web to prevent pivoting of said carrier about said joint due to tension in the web.

* * * * *